US005307578A

United States Patent [19]

Fichtenau

[11] Patent Number: 5,307,578

[45] Date of Patent: May 3, 1994

[54] NETTING FOR FENCES FOR SPORTING ACTIVITIES HAVING INDICIA BEARING SIDES AND METHOD THEREFOR

[75] Inventor: Hans G. E. Fichtenau, Stuttgart, Fed. Rep. of Germany

[73] Assignees: Michael H. Alt, Stuttgart; Lothar Hackmann, Gerlingen, both of Fed. Rep. of Germany

[21] Appl. No.: 737,895

[22] Filed: Jul. 26, 1991

Related U.S. Application Data

[63] Continuation of Ser. No. 74,428, filed as PCT/DE86/00452, Nov. 7, 1986, published as WO87/02900, May 21, 1987, abandoned.

[30] Foreign Application Priority Data

Nov. 9, 1985 [DE] Fed. Rep. of Germany ..... 3539856

[51] Int. Cl.[5] ..... G09F 7/00

[52] U.S. Cl. ..... 40/584; 428/919

[58] Field of Search ..... 40/559, 593, 591; 160/DIG. 7; 428/919

[56] References Cited

U.S. PATENT DOCUMENTS

| | | | |
|---|---|---|---|
| 243,962 | 7/1881 | Palmer | 160/DIG. 7 |
| 2,176,614 | 10/1939 | Simpson | 40/559 |
| 2,402,709 | 6/1946 | Swasey | 160/DIG. 7 |
| 2,779,117 | 1/1957 | Russo | 40/617 |
| 2,825,168 | 3/1958 | Ekman | 428/919 |

FOREIGN PATENT DOCUMENTS

| | | | |
|---|---|---|---|
| 106629 | 4/1984 | European Pat. Off. | 40/591 |
| 951792 | 10/1956 | Fed. Rep. of Germany . | |
| 1630826 | 7/1971 | Fed. Rep. of Germany | 40/593 |

OTHER PUBLICATIONS

Tennis, Nr. 9, May 1, 1978 pp. 23, 24.

*Primary Examiner*—Kenneth J. Dorner
*Assistant Examiner*—Cassandra Davis
*Attorney, Agent, or Firm*—Edwin E. Greigg; Ronald E. Greigg

[57] ABSTRACT

Netting, consisting of threads (3) of wires for fences and/or sporting activities, as an information carrier, being coated each on one of the two viewing sides I and III, in which instance the coating (6) of each thread (3) or wire extends up to an imaginary center plane (7) of the netting as a maximum, splitting said netting into two halves of the threads (3) or wires, rendering visible each half from one side only.

9 Claims, 1 Drawing Sheet

Figure 1:
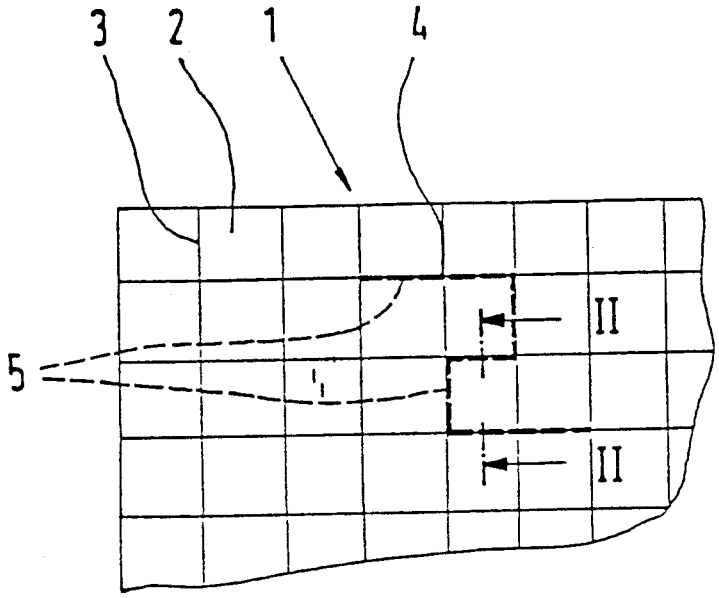

NETTING FOR FENCES FOR SPORTING ACTIVITIES HAVING INDICIA BEARING SIDES AND METHOD THEREFOR

This is a continuation of copending U.S. application Ser. No. 07/074,428 filed as PCT/DE86/00452, Nov. 7, 1986, published as WO87/02900, May 21, 1987, abandoned.

STATE-OF-THE-ART

The subject invention concerns an area netting, consisting of threads or wires for fences and/or sporting activities. Such netting of threads may consist of textile fibers, of metal, of plastics or of other matter and it may either serve as a separating, however, transparent area for which reason frequently of net-plays as, for instance, with tennis is spoken of or it may serve as a means for marking territories in order to preventing the transgression from one territory to some other, such as protective fences separating the football players from the spectators which fences, of course, should not interfere with the vision. Netting of this kind may also further be employed for the protection of spectators against flying objects such as balls, sporting equipment and the like. In each case such area netting possesses dimensions which agree with the intended purposes, this are a netting being looked at from both sides without obstructing the sight through this netting. As to the rest, the user of such netting takes great care on one side to have this netting as such sufficiently recognizable—as a separating area, for instance—and on the other side to avoid poor vision through the netting.

ADVANTAGES OF THE INVENTION

According to the invention the netting has the advantage of being available as an information carrier, such as for advertising purposes, since the section coated by the coloring substance will at al times be recognizable on one side of the netting only. On its backside, however, such netting is recognizable in its original coloring, that is in the shade of the basic material as, for instance, of the textile fiber.

The reason of using such netting in part only as information carriers rests, among others, on the fact that normally colored netting displays mirror images of the colored part so that the use of text as an advertising means, for instance, will be readable from one side of the area netting only while the other side displays mirror writing.

This invention renders possible profitable wind-insensitive, luminous advertising on top of high buildings, transparencies over, for instance, streets provided for races or also to replace advertising widths crossing traffic lanes by streamlined netting.

According to an advantageous design of the invention, the coloring layer is produced by spraying. During application of the coloring substance, simply a pattern is laid upon same netting and in this manner the coloring substance is applied to but one side of the netting area and so of the threads or wires.

According to a further design of the invention, the coloring substance consists of matter to be washed out so that the character of the information may be changed at will without destroying the netting proper.

According to an additional design of the invention, the coloring substance may consist of phosphorescent matter. This allows the information to further emit light even after cutting-out of the illumination or during the evening and night hours.

According to a further design of the invention, the thread has a minimum diameter of one (1) millimeter so that the colored surface is well recognizable. Or, the mesh size of the netting is thirty (30)millimeters minimum so that a good transparency is spite of the coating is preserved.

DRAWING

On example for the execution of the matter of the subject invention is shown in the drawing and described in detail subsequently. There are—

Figure 2:
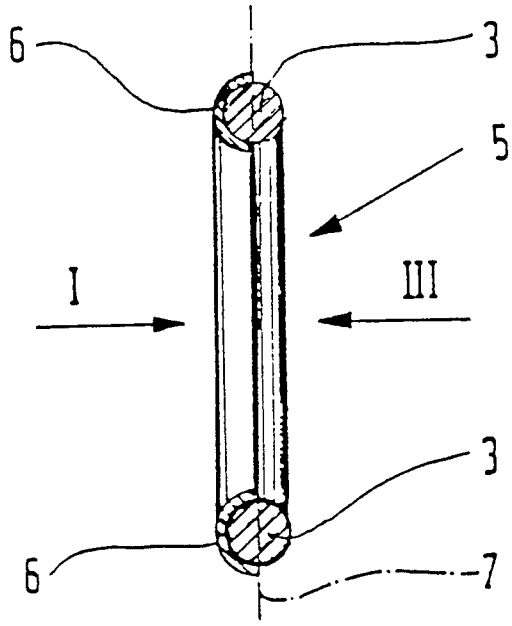

FIG. 1 an area netting with sight according to arrow I in FIG. 2 onto the one side of the area which displays a sectionwise coloring; and FIG. 2 a section according to line II—II in FIG. 1 through the two threads or wires of the netting in an enlarged scale.

DESCRIPTION OF THE EXAMPLE OF EXECUTION

FIG. 1 shows a simple netting such as is used, for instance, on a tennis-court in which an area configuration 1, shown in part only, is formed by a number of meshes (2) in which instance the threads (3) or wires limit these meshes (2) by knots (4) in a rectangular shape or in a rhomboidal one, if distorted.

Such netting may be knotted as is mostly the case. It may, however, equally well be of a braided or woven nature for different types of application or it may be one-piece stamped or sprayed from plastics or metal.

In FIG. 1, a few threads (5) of the netting are shown dash-lined, generating in this manner the information upon the area netting. Threads shown dash-lined are coated with a coloring substance for discriminating them against the remaining ones.

In FIG. 2, these threads are shown in an enlarged scale and as a section in which instance the core thread (3) is identical with the one in the netting of FIG. 1 and only that half of the thread directed to the vision by arrow (I) is coated with a coloring substance (6). The arrow indicates this direction of sight which is produced by the top view of FIG. 1 whereas the arrow III shows the backside aspect. When the spectator looks at the area netting in accordance with arrow III, he cannot perceive the colored layer (6) and therefore does not also read the information (5) as shown in FIG. 1. For his vision, the netting does not display any information at all. This fact does not prevent the application of the same information upon this netting area, directed in regard to direction III which information will then be visible on the other side only from this side III. The area configuration 1 is split up into two halves by the visual sides I and III, these halves being represented by an imaginary, dash-dotted center plane (7).

I claim:

1. A netting comprised of intersecting strands of material, the strands being disposed in an open relationship to one another and fixed to each other at their intersecting points to form a lattice having an open mesh pattern with first and second sides at least one of said sides of said lattice being coated with a colored substance comprising phosphorescent matter and having a color different from said netting. said colored substance being applied to said strands and said intersecting points of said lattice to coat said strands and said intersecting points up to one-half of their periphery along a plane through the midpoint thereof only, said colored substance adapted to convey information and having a consistency which is visible to a viewer from only one side of said lattice and not visible through the strands from the uncoated side.

2. A netting as claimed in claim 1, further wherein said first and second sides of the lattice are coated with different coatings of a colored substance, each of which can be viewed from only one side of said netting.

3. A netting as claimed in claim 1, further wherein said strands are formed or wires.

4. A netting as claimed in claim 1, further wherein said strands are formed of threads.

5. A netting as claimed in claim 1, further wherein said strands have a diameter of one millimeter.

6. A netting as claimed in claim 3, further wherein said coating of information comprises an advertisement.

7. A netting as claimed in claim 2, further wherein the coatings applied to the two sides of said lattice are different colored substances and convey different messages.

8. A netting as claimed in claim 1, wherein said strands have an open mesh pattern of 30 millimeters.

9. A netting as claimed in claim 1, wherein said strands have a diameter of one millimeter and the open mesh pattern has a mesh of 30 millimeters.

* * * * *